US008746254B2

(12) United States Patent
Luan et al.

(10) Patent No.: US 8,746,254 B2
(45) Date of Patent: Jun. 10, 2014

(54) COMPOSITE MATERIALS AND THEIR USE IN SMOKING ARTICLES

(71) Applicant: Philip Morris USA Inc., Richmond, VA (US)

(72) Inventors: Zhaohua Luan, Midlothian, VA (US); Diane L. Gee, Richmond, VA (US); Jose Nepomuceno, Beaverdam, VA (US); Shuzhong Zhuang, Midlothian, VA (US); Jay A Fournier, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 13/765,246

(22) Filed: Feb. 12, 2013

(65) Prior Publication Data

US 2013/0146072 A1 Jun. 13, 2013

Related U.S. Application Data

(62) Division of application No. 10/741,482, filed on Dec. 22, 2003, now Pat. No. 8,381,738.

(51) Int. Cl.
*A24F 1/20* (2006.01)

(52) U.S. Cl.
USPC ..... 131/207; 131/331; 131/332; 131/341; 131/342

(58) Field of Classification Search
None
See application file for complete search history.

(56) References Cited

U.S. PATENT DOCUMENTS 1,959,093 A 5/1934 Davis
3,003,504 A 10/1961 Touey et al.
3,091,550 A 5/1963 Doying
3,217,715 A 11/1965 Berger et al.
3,327,718 A 6/1967 Kilburn
3,353,544 A 11/1967 Fordyce et al.
3,403,202 A 9/1968 Green (Continued)

FOREIGN PATENT DOCUMENTS

CN 2031615 U 2/1989
CN 1280879 1/2001

(Continued)

OTHER PUBLICATIONS

"interstice", Merriam-Webster Online Dictionary, 2009, Merriam-Webster Online Jun. 3, 2009, <http://www.merriam-webster.com/dictionary/interstice>.

(Continued)

*Primary Examiner* — Michael J Felton
(74) *Attorney, Agent, or Firm* — Buchanan Ingersoll & Rooney PC

(57) ABSTRACT

Smoking articles, filters, and methods for selectively removing selected components from tobacco smoke are disclosed. The smoking articles and filters include composites composed of a porous alumina and/or aluminosilicate matrix containing particles of activated carbon and zeolite molecular sieve adsorbents distributed throughout the matrix which can selectively remove selected components of tobacco smoke. The composites may be made by admixing the adsorbent mixture and a binder such as aluminum hydroxide or montmorillonite clay, adding an aqueous mineral acid to gel the mixture and drying and firing the gel paste. The proportions and adsorption capacities of the components can be selected to tailor the adsorption characteristics of the composites to selectively remove targeted constituents such as acrolein and 1,3-butadiene in tobacco smoke. Methods for making filters and smoking articles using the composites, as well as methods for smoking products comprising the composites, are also provided.

19 Claims, 5 Drawing Sheets

(56) References Cited

U.S. PATENT DOCUMENTS

| | | | |
|---|---|---|---|
| 3,652,461 | A | 3/1972 | Dalton |
| 3,957,059 | A | 5/1976 | Rainer et al. |
| 4,038,992 | A | 8/1977 | Ogasa et al. |
| 4,062,368 | A | 12/1977 | Crellin et al. |
| 4,246,910 | A | 1/1981 | Rainer et al. |
| 4,440,867 | A | 4/1984 | Sabherwal |
| 4,530,765 | A | 7/1985 | Sabherwal |
| 4,994,191 | A | 2/1991 | Kuznicki et al. |
| 5,132,260 | A | 7/1992 | Plee |
| 5,149,435 | A | 9/1992 | Laube |
| 5,320,773 | A | 6/1994 | Perman et al. |
| 5,346,679 | A | 9/1994 | Osaki et al. |
| 5,421,860 | A | 6/1995 | Bretz et al. |
| 5,499,636 | A | 3/1996 | Baggett, Jr. et al. |
| H1579 | H | 8/1996 | Furio |
| 5,568,819 | A | 10/1996 | Gentry et al. |
| 5,657,772 | A | 8/1997 | Duke et al. |
| 5,705,269 | A | 1/1998 | Pimenov et al. |
| 5,727,573 | A | 3/1998 | Meier et al. |
| 5,915,387 | A | 6/1999 | Baggett, Jr. et al. |
| 5,988,176 | A | 11/1999 | Baggett, Jr. et al. |
| 6,074,974 | A | 6/2000 | Lee et al. |
| 6,107,354 | A | 8/2000 | Shaniuk et al. |
| 6,117,810 | A | 9/2000 | Lee et al. |
| 6,238,467 | B1 | 5/2001 | Azarian et al. |
| 6,286,516 | B1 | 9/2001 | Bowen et al. |
| 6,345,625 | B1 | 2/2002 | Chew |
| 6,591,839 | B2 | 7/2003 | Meyer et al. |
| 6,930,067 | B2 | 8/2005 | O'Connor et al. |
| 7,160,831 | B2 | 1/2007 | Vaughn et al. |
| 7,448,392 | B2 | 11/2008 | Fournier et al. |
| 7,827,996 | B2 | 11/2010 | Fournier et al. |
| 8,381,738 | B2 | 2/2013 | Luan et al. |
| 2004/0016436 | A1 | 1/2004 | Thomas |
| 2004/0194792 | A1 | 10/2004 | Zhuang et al. |

FOREIGN PATENT DOCUMENTS

| | | | |
|---|---|---|---|
| DE | 1038015 | | 9/1958 |
| DE | 2917313 | A1 | 11/1980 |
| EP | 1029461 | A2 | 8/2000 |
| GB | 2003721 | A | 3/1979 |
| JP | 54053669 | A | 4/1979 |
| KR | 9-303904 | | 5/1993 |
| RU | 2122893 | C1 | 12/1998 |
| RU | 2122894 | C1 | 12/1998 |

OTHER PUBLICATIONS

"pore", Merriam-Webster Online Dictionary, 2009, Merriam-Webster Online Jun. 3, 2009, <http://www.merriam-webster.com/dictionary/pore>.

Ryu, Zhenyu et al., "Characterization of pore size distributions on carbonaceous adsorbents by DFT", 1999, Carbon, vol. 37, Elsevier Science Ltd., pp. 1257-1264.

Zdravkov, Borislav D. et al., "Pore classification in the characterization of porous materials: A perspective", Central European J. Chem. 5(2):385, 2007.

PICA Carbon - Zeolite Composites as Filter Additives

Control: 1R4F; Method: 4th puff; Configuration: 2.5 mm plug-space-plug

COMPOSITE MATERIALS AND THEIR USE IN SMOKING ARTICLES

BACKGROUND

Certain filter materials have been suggested for incorporation into cigarette filters, including cotton, paper, cellulose, and certain synthetic fibers. However, such filter materials generally only remove particulate and condensable components from tobacco smoke. Thus, they are usually not optimal for the removal of certain gaseous components from tobacco smoke, e.g., volatile organic compounds.

SUMMARY

A smoking article is provided which includes tobacco and a filter system comprising a composite composed of an alumina and/or aluminosilicate matrix having particles of at least one activated carbon and at least one zeolite distributed throughout the pores of the matrix. Also provided is a composite filter system, a method of making the composite filter system, a method of making smoking articles containing said filter system and a method of selectively removing targeted constituents from tobacco smoke.

In one embodiment, a composite filter system is manufactured by preparing an aqueous mixture containing particles of an activated carbon and at least one zeolite with a matrix precursor material which gels upon acidification, acidifying the aqueous mixture to form a gel, and heating the gel to form a composite comprising particles of activated carbon and zeolite uniformly dispersed in an inorganic matrix.

Preferably, the precursor materials mentioned above include acidified aluminum hydroxide and montmorillonite clay. Upon thermal treatment, they form alumina and/or aluminosilicate matrices having high surface areas with particles of activated carbon and zeolites distributed throughout the matrix.

In another embodiment, smoking articles contain tobacco and the filter system mentioned above. A preferred smoking article is a traditional or non-traditional cigarette. The filter system may be incorporated into a filter and/or in cigarette paper surrounding a filter.

Another embodiment relates to a method of making a cigarette, said method comprising: (i) providing a cut filler to a cigarette making machine to form a tobacco column; (ii) placing a paper wrapper around the tobacco column to form a tobacco rod; (iii) providing a cigarette filter comprising the composite filter system described above; and (iv) attaching the cigarette filter to the tobacco rod to form the cigarette.

In yet another embodiment, a method of smoking a smoking article containing a composite as described above, comprises lighting the smoking article to form smoke and drawing the smoke through the cigarette, wherein during the smoking of the cigarette, the composite filter system preferentially removes one or more targeted components from mainstream smoke.

In yet another embodiment, a cigarette filter is provided comprising a composite containing at least one activated carbon and at least one zeolite molecular sieve capable of selectively reducing at least one component in mainstream tobacco smoke.

DETAILED DESCRIPTION OF PREFERRED EMBODIMENTS

Figure 1:
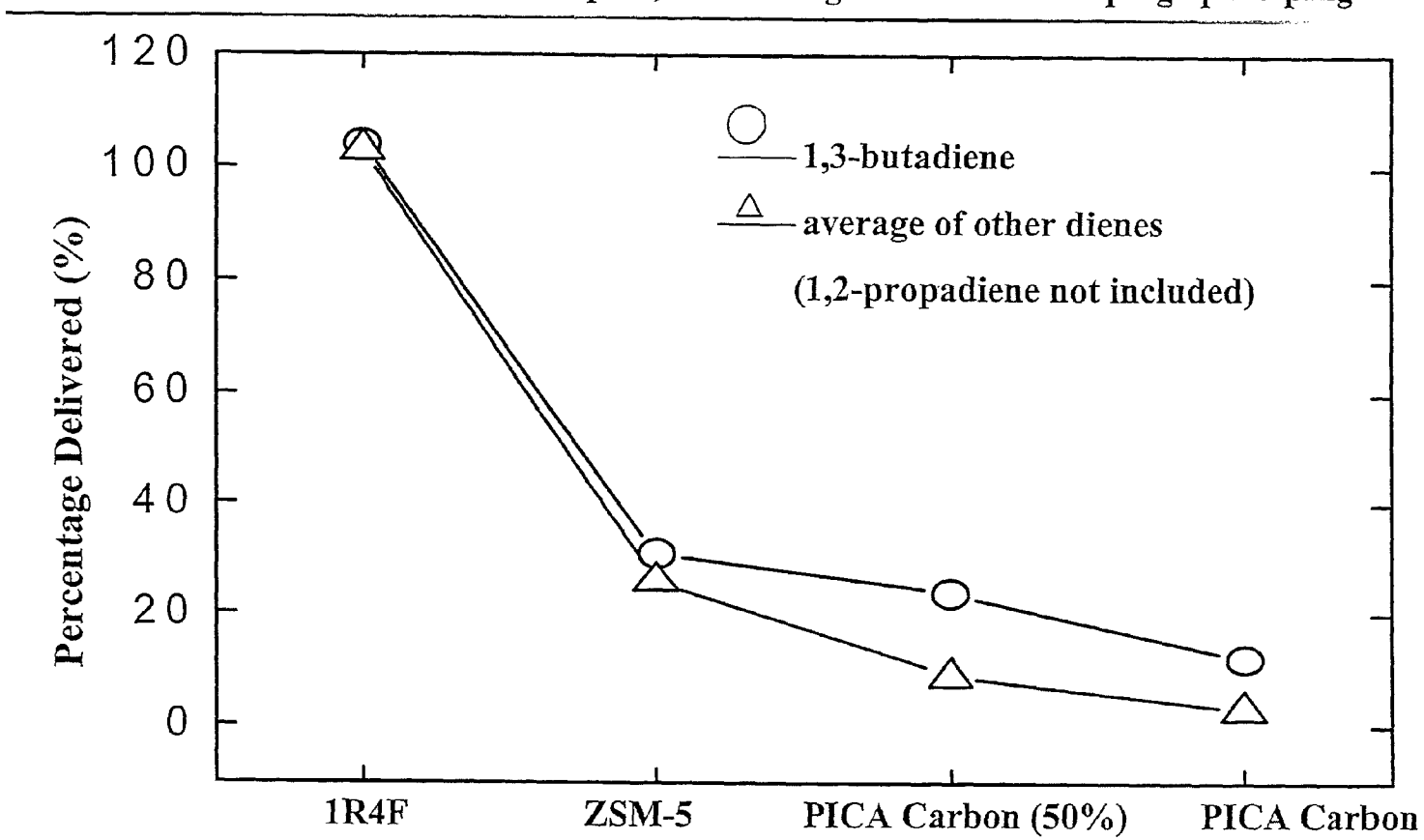
FIG. 1 is a graph showing the efficiency of various adsorbents in removing butadiene 1,3 or other dienes (1,2-pentadiene, cyclopentadiene, 2,4-hexadiene, 1,3-cyclohexadiene and methyl-1,3-cyclopentadiene) from tobacco smoke.

Cigarette filters and smoking articles are provided comprising a porous composite containing particles of an activated carbon and a zeolite molecular sieve capable of selectively removing selected components from mainstream smoke. Methods for making such cigarette filters and smoking articles, as well as methods of smoking cigarettes, are also provided.

The term "adsorption" is intended to encompass interactions on the outer surface of the activated carbon, zeolite and matrix, as well as interactions within the pores and channels thereof. An "adsorbent" is a substance that has the ability to condense or hold molecules of other substances on its surface and/or the ability to take up other substances, i.e., through penetration of the other substances into its inner structure or into its pores. The term "adsorbent" as used herein refers to either an adsorbent, an absorbent, or a substance that can function as both an adsorbent and an absorbent. The term "remove" as used herein refers to adsorption and/or absorption of at least some portion of a selected component of mainstream tobacco smoke.

The term "mainstream smoke" includes the mixture of gases which passes down the tobacco rod and issues through the filter end, i.e., the amount of smoke issuing or drawn from the mouth end of a smoking article during smoking. The mainstream smoke contains air that is drawn in through both the lit region of the smoking article, as well as through the paper wrapper.

Smoking articles, such as cigarettes, pipes, and cigars, as well as non-traditional cigarettes, are provided. Non-traditional cigarettes include, for example, cigarettes for electrical smoking systems as described in commonly-assigned U.S. Pat. Nos. 6,026,820; 5,988,176; 5,915,387; and 5,499,636.

Activated forms of carbon generally have strong physical adsorption forces, and high volumes of adsorbing porosity. A preferred activated carbon is commercially available from PICA USA, Inc. The activated carbon could also be manufactured by any suitable method known in the art. Such methods include the carbonization of coconut husk, coal, wood, pitch, cellulose fibers, or polymer fibers, for example. Carbonization is usually carried out at high temperatures, i.e., 200-1000° C. in an inert atmosphere, followed by activation at a temperature between 500-1000° C. with an oxidation agent, e.g., $CO_2$ or $H_2O$. The activated carbon produced could be in the form of granules, beads or powder.

In one embodiment, granulated carbon typically having particles ranging in size from about 0.1 mm to about 2 mm or pelleted carbon having particles ranging in size from about 0.5 mm to about 2 mm or mixtures thereof is used. In a preferred embodiment, carbon particles ranging in size from about 0.250 to about 0.850 mm are used. In terms of Tyler screen mesh size, the carbon particles are preferably from about 9 mesh to about 150 mesh, preferably 12 to 80 mesh, and more preferably from about 20 to 60 mesh.

Carbon particles may also have a distribution of micropores, mesopores and macropores. The term "microporous" generally refers to such materials having pore sizes of about 20 Å or less while the term "mesoporous" generally refers to such materials with pore sizes of about 20-500 Å. In a preferred embodiment, the proportion of micropores to mesopores will be at least 50:40. In a most preferred embodiment, the pores of the activated carbon comprise at least 80% micropores. The relative amounts of micropores, mesopores and macropores will depend upon the selected components from mainstream tobacco smoke that are to be targeted and removed. Thus, the pore sizes and pore distribution can be adjusted accordingly as needed for a certain application.

The other material used as an adsorbent in the filter system is a molecular sieve zeolite. The term "molecular sieve" as used herein refers to a porous structure composed of an inorganic silicate material. Zeolites have channels or pores of uniform, molecular sized dimensions. There are many known unique zeolite structures having different sized and shaped channels or pores. The size and shape of the channels or pores can significantly affect the properties of these materials with regard to adsorption and separation characteristics. Zeolites can be used to separate molecules by size and shape possibly related to the orientation of the molecules in the channels or pores, and/or by differences in strength of sorption. By using one or more zeolites having channels or pores larger than selected components of mainstream smoke, only selected molecules that are small enough to pass through the pores of the molecular sieve material are able to enter the cavities and be sorbed by the zeolite.

Molecular sieves which are useful in the composites of the invention include zeolites, silicoaluminophosphates (AlPO/SAPO) and mesoporous molecular sieves such as MCM-41, MCM-48 and SBA-15. These are powder materials. This family of materials contains regular arrays of uniformly-sized channels and tunable internal active sites, and admits molecules below a certain size into their internal space which makes them useful as catalysts and adsorbents where selectivity is critical. Microporous, mesoporous and/or macroporous molecular sieves may be used. They are selected for use in the filter system based on the particular component(s) to be removed from the mainstream smoke.

As indicated previously, the pore size of the zeolite molecular sieve can be selected based on the size of one or more selected components that are to be removed from mainstream smoke. The zeolite molecular sieve should have an average pore diameter larger than such selected components, and smaller than the diameter of at least one tobacco smoke component that is desired to be retained in the mainstream smoke. Preferably, the zeolite molecular sieve sorbent has an average pore diameter larger than that of at least one of acrolein and 1,3-butadiene, and smaller than the diameter of at least one tobacco smoke constituent that is desired to be retained in the mainstream smoke, such as flavor components. Thus, zeolites preferably are selected to remove at least one of 1,3-butadiene and acrolein from mainstream smoke. Other constituents which can be selectively removed include, for example, aldehydes such as acetaldehyde and isobutraldehyde, and isoprene. Zeolite ZSM-5 and zeolite BETA can be used to selectively remove selected components from mainstream smoke, including acrolein and 1,3-butadiene.

The term "microporous molecular sieves" generally refers to molecular sieve materials having pore sizes of about 20 Å or less. The term "mesoporous molecular sieves" generally refers to such materials with pore sizes of about 20-500 Å. Materials with pore sizes of about 500 Å or larger may be referred to as "macroporous molecular sieves". In embodiments, one or more different types of molecular sieves may be used in combination.

The filter system can be prepared by a gelation technique using a matrix precursor material which forms a gel upon acidification. The gel can be fired at elevated temperatures to form a porous aluminosilicate and/or activated alumina matrix. In one embodiment, particles of at least one activated carbon and at least one zeolite are admixed with an aluminum hydroxide in powdered form, such as alumina boehmite. The ingredients are ground and mixed to form a uniform blend which is then admixed with dilute mineral acid. The admixture is thoroughly blended to form a uniform gel and conditioned at room temperature for up to several hours. The resultant paste-like dispersion has sufficient strength to be shaped into various configurations such as rods, tubes, granules, etc. The paste-like dispersion is dried by heating at temperatures up to about 100° C. and then heated in air at temperatures up to about 300° C. to form the desired composite. Known activation techniques also can be employed to remove volatiles and produce the composite. The product is a composite filter system composed of a porous matrix of activated alumina having particles of activated carbon and zeolite distributed uniformly throughout the matrix.

The ratios by weight of activated carbon and zeolite can be varied over a wide range depending upon a variety of factors including particle sizes, pore sizes, smoke constituents to be removed, etc. In general, from about 5-95 wt. % of activated carbon and 95-5 wt. % zeolite can be employed e.g., in activated carbon/zeolite ratios of 0.05-0.2:0.8-0.95, 0.2-0.4:0.6-0.8, 0.4-0.6:0.4-0.6, 0.6-0.8:0.2-0.4, 0.8-0.9.5:0.05-0.2.

Suitable matrix precursors can be selected from materials which form gels upon acidification and can be heated at elevated temperatures to form porous matrices having high surface areas.

Aluminum hydroxides ($Al(OH)_3$ alone or in admixture with minor amounts of other oxides are preferred matrix precursor materials. These include an alumina boehmite, such as Catapal B alumina from Condea Vista. Also preferred are clays such as montmorillonite and those containing montmorillonite (e.g., bentonites, fuller's earth). The matix precursor should be capable of forming gels in aqueous dispersions upon acidification (i.e. at a pH less than 7) when contacted with such materials as dilute mineral acids (0.1-5.0 N, preferably 0.2-1.0 N HCl).

According to a preferred embodiment, the activated carbon/zeolite adsorbent mixture and the matrix precursor material are present in a ratio of adsorbent mixture to binder of between about 1:0.05 to 1:2.5 by weight, preferably about 1:0.125 to 1:0.5. In this range, the amounts of zeolite and activated carbon are further selected based upon the amount and type of constituent to be targeted and the surface area of the absorbent materials. A preferred composite is selective toward the adsorption of targeted compounds in mainstream cigarette smoke, such as aldehydes, ketones, dienes, aromatics such as benzene, HCN, nitriles, etc. and is therefore particularly useful in the selective removal of acrolein and dienes.

In a preferred embodiment, the composite is located in at least a filter portion of a smoking article. Typically, about 10 mg to about 300 mg of the composite can be used in a cigarette filter. For example, within the usual range, amounts such as about 20, 30, 50, 75, 100, 150, 200, or 250 mg of the composite can be used in the cigarette filter.

Various filter constructions known in the art may be used to locate the composite. Exemplary filter structures that can be used include, but are not limited to, a mono filter, a dual filter, a triple filter, a cavity filter, a recessed filter or a free-flow filter. Mono filters typically contain cellulose acetate tow or cellulose paper materials. Pure mono cellulose filters or paper filters offer good tar and nicotine retention, and are highly degradable. Dual filters typically comprise a cellulose acetate mouth side and a pure cellulose or cellulose acetate segment. In such dual filters, the composite is preferably located closer to the smoking material or tobacco side of a cigarette. The length and pressure drop of the two segments of the dual filter can be adjusted to provide optimal adsorption, while maintaining acceptable draw resistance.

Triple filters can include mouth and smoking material or tobacco side segments, and a middle segment comprising a material or paper. The composite can be provided in the middle segment. Cavity filters typically include two segments, e.g., acetate-acetate, acetate-paper or paper-paper, separated by a cavity. The composite can preferably be provided in the cavity. Recessed filters include an open cavity on the mouth side, and typically incorporate the composite into the plug material. The filters may also optionally be ventilated, and/or comprise additional sorbents (such as charcoal or magnesium silicate), catalysts, flavorants or other additives used in the cigarette filter art.

In an example, 10 g activated PICA carbon is combined with 10 g ZSM-5 zeolite material and 1-50 g (preferably 2.5-10.0 g) aluminum hydroxide (Catapal B alumina or boehmite). The mixture is ground and mixed uniformly, then admixed with 10-50 ml (preferably 15-25 ml) dilute mineral acid solution in water of 0.1-5.0 N (preferably 0.2-1.0 N) and mixed thoroughly to form a uniform gel. The gel is conditioned at room temperature for several hours, the resultant paste dried at 100° C. and finally converted to the desired composite by heating in air at a temperature up to 300° C.

Activated carbons and zeolite-type molecular sieves when combined together with a porous matrix can produce composite materials with tailored adsorption capacity and selectivity for application in smoking articles to selectively reduce targeted smoke constituents. The preparation of the composite materials involves using an inorganic material such as aluminum hydroxide or montmorillonite clay, which gelates upon acidification and forms porous alumina and/or aluminosilicate type structures upon further thermal treatment.

The gel may be conditioned at or about room temperature for up to several hours, dried at about 100° C. and finally activated in air at temperatures up to 300° C. or via a standard carbon activation process in order to remove various volatile chemicals. The preferred composites comprise porous alumina and/or aluminosilicate type matrices containing activated carbons and zeolite-type molecular sieve materials dispersed uniformly throughout the pores of the matrices. Their adsorption capacity and selectivity can be tailored by selecting ratios of starting materials having preselected adsorption characteristics. In the form of pastes before drying, the pastes can be readily engineered into composites having a desirable particle size and/or shape suitable for use in a smoking article.

Figure 2:
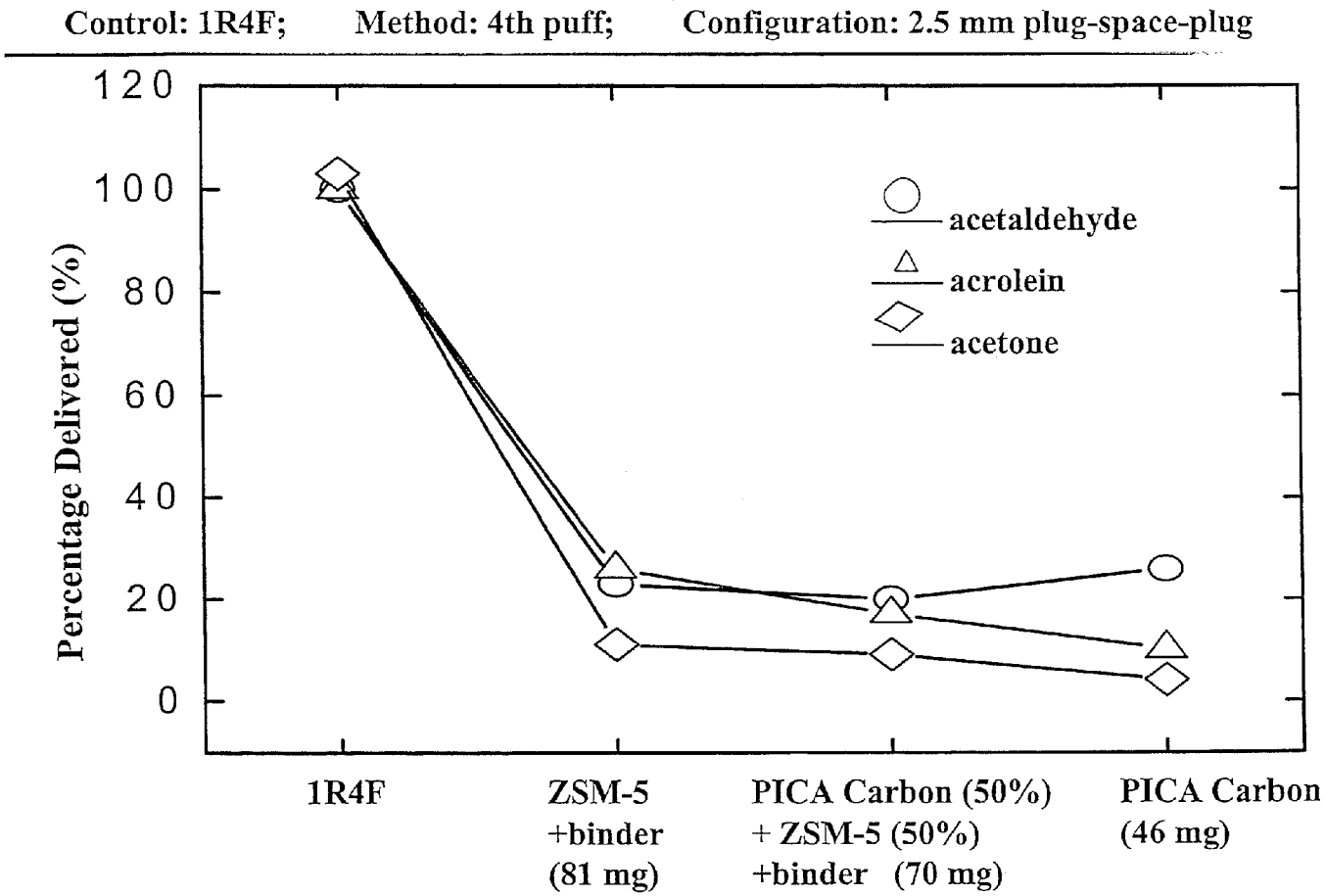
FIG. 2 is a graph showing the efficiency of various adsorbents in removing aldehydes and ketones from tobacco smoke.
Figure 3:
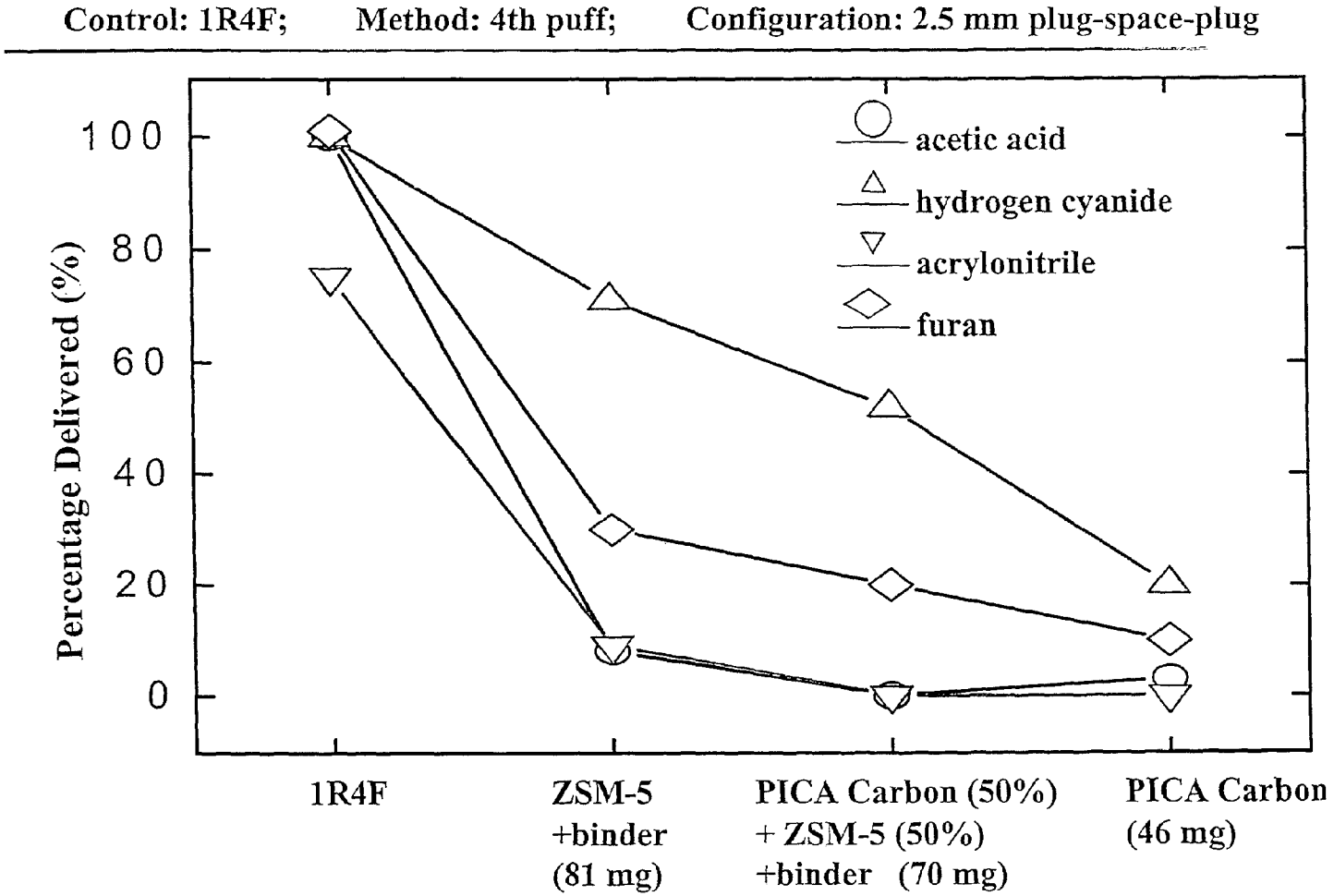
FIG. 3 is a graph showing the efficiency of various adsorbents in removing acids, nitriles and furan from tobacco smoke.
Figure 4:
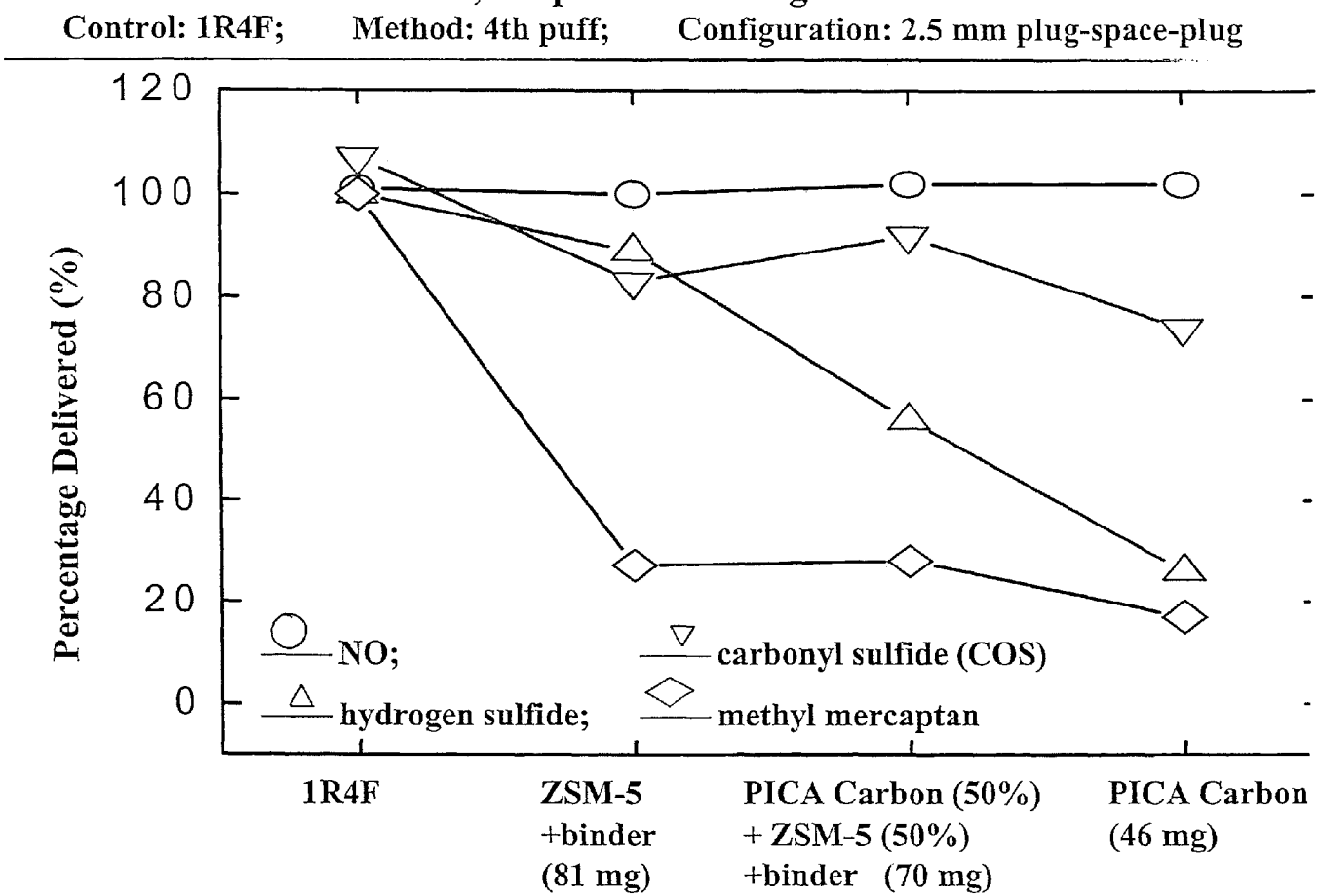
FIG. 4 is a graph showing the efficiency of various adsorbents in removing NO and sulfur-containing constituents from tobacco smoke.
Figure 5:
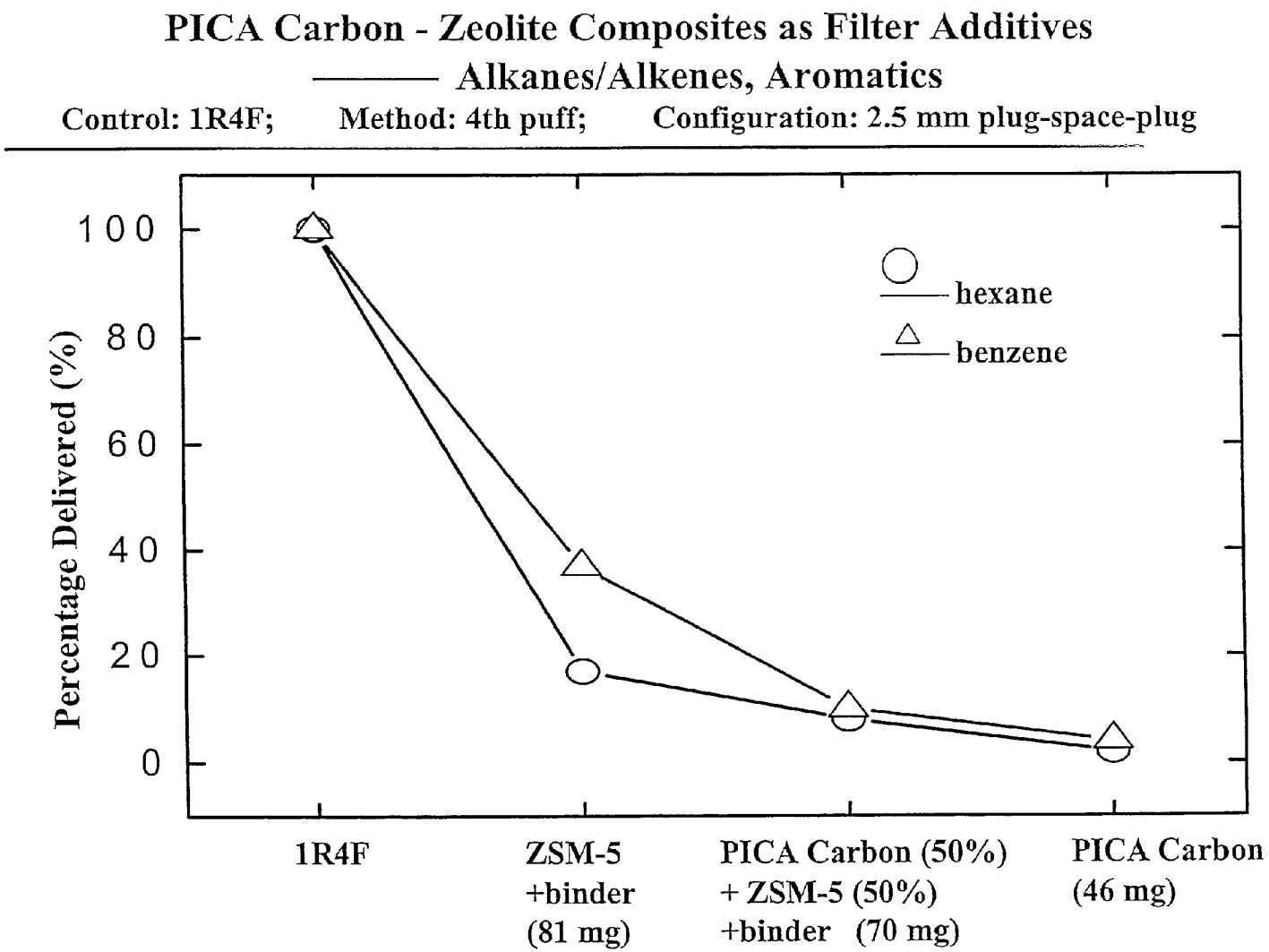
FIG. 5 is a graph showing the efficiency of various adsorbents in removing alkanes such as hexane and aromatics such as benzene from tobacco smoke.

The efficiency of the composites in selectively removing various constituents of cigarette smoke is shown in FIGS. 1-5. Samples are prepared by modifying three industry standard reference 1R4F cigarettes. Samples of adsorbents are loaded into a space of a plug-space-plug filter configuration of a 1R4F cigarette and the three modified cigarettes are smoked under FTC conditions (2 second 35 $cm^3$ puff every 60 seconds). The fourth puff is analyzed using gas chromatography/mass spectrometer (GC/MS). For each of the samples, the percent delivered of different gas phase smoke constituents is measured versus that of the unmodified 1R4F cigarette. The results are shown in FIGS. 1-5.

The composite can be provided with a surface area effective to preferentially adsorb selected constituents from cigarette smoke. While surface area is inversely proportional to particle size, adsorbents having small particle size may pack together too densely to permit mainstream smoke to flow through the filter during smoking. If particle size is too large, there will be less than desired accessible surface area. Therefore, these factors can be considered in manufacturing a composite having a particular particle size.

The mixture of zeolite and activated carbon used in making the composite may be chosen to target selected constituents in mainstream smoke, and may be located either on the exterior and/or interior surfaces of the matrix, or may be embedded within the pores of the matrix. The selection of starting materials permits the preferential removal of one or more selected constituents from mainstream smoke, while retaining other constituents, such as those relating to flavor. Usually substituents relating to flavor are of larger size and/or molecular weight, while smaller substituents, such as light gases, various aldehydes and small molecules may be targeted for removal. The selectivity of the composite can be fine tuned, particularly by the selection of zeolites, activated carbons and binders as well the choice of particle sizes and pore sizes. Preferably at least 10%, 20%, 30%, 40%, 50% or more of the selected constituent is removed from the tobacco smoke by the composite.

Variations and modifications of the foregoing embodiments will be apparent to those skilled in the art. Such variations and modifications are to be considered within the purview and scope of the claims appended hereto.

All of the above-mentioned references are herein incorporated by reference in their entirety to the same extent as if each individual reference was specifically and individually indicated to be incorporated herein by reference in its entirety.

What is claimed is:

1. A method of making a cigarette comprising the steps of:

(i) providing a cut filler to a cigarette making machine to form a tobacco column;

(ii) placing a paper wrapper around the tobacco column to form a tobacco rod;

(iii) providing a cigarette filter containing a composite containing particles of activated carbon and zeolite within a porous matrix; and (iv) attaching the cigarette filter to the tobacco rod to form the cigarette.

2. The method of claim 1, wherein the matrix is derived from a material which gels upon contact with an acid.

3. The method of claim 2, wherein the material comprises aluminum hydroxide, alumina boehmite, or a montmorillonite-containing clay.

4. The smoking article method of claim 1, wherein the molecular sieve comprises a crystalline alumino-silicate, a zeolite, a silicoaluminophosphate or a mesoporous molecular sieve.

5. The method of claim 4, wherein the molecular sieve comprises an alumina-silicate zeolite.

6. The method of claim 1, wherein the activated carbon has a pore size of about 3-500 Å.

7. The method of claim 1, wherein the composite has an average surface area of from about 20 to 1500 $m^2/g$.

8. The method of claim 1, wherein the composite is in the form of a powder, granules, monolith or mixtures thereof.

9. The smoking article method of claim 1, wherein the filter component is a mono filter, a dual filter, a triple filter, a cavity filter, a recessed filter or a free-flow filter.

10. The method of claim 1, wherein the filter component comprises paper or fibers.

11. The method of claim 1, wherein the filter component comprises cellulose acetate tow, cellulose paper, mono cellulose, mono acetate or combinations thereof.

12. The method of claim 1, wherein the composite is incorporated into at least one cigarette filter part selected from the group consisting of a shaped paper inset, a plug, a space, cigarette filter paper, and a free-flow sleeve.

13. The method of claim 1, wherein the porous matrix is derived from an aluminum hydroxide or a montmorillonite clay.

14. A method of manufacturing a cigarette filter, comprising incorporating into a cigarette filter, a porous composite comprising an alumina and/or aluminosilicate having activated carbon and zeolite molecular sieve particles distributed in the pores thereof, the composite being loaded on a support, incorporated in a support, incorporated with a support, in a plug-space-plug arrangement, in bead form, and/or in monolith form.

15. The method according to claim 14, wherein the porous composite is prepared by a process comprising:

preparing an aqueous mixture comprising particles of at least one activated carbon and at least one zeolite with a precursor matrix material which gels in contact with an acid;

adding an aqueous mineral acid to the mixture to form a gel;

drying the gel to form a gel paste; and heating the paste to form a composite comprising particles of activated carbon and zeolite within a porous matrix.

16. The method of claim 15, wherein the step of drying the gel is conducted at a temperature of less than about 100° C.

17. The method of claim 15, wherein the step of heating to form the composite is conducted at a temperature of up to about 300° C.

18. The method of claim 17, wherein the step of heating comprises heating the gel paste to a temperature sufficient to convert the matrix precursor material to a porous matrix.

19. The method of claim 15, wherein the gel paste is formed into a selected size and shape before heating to form the composite.

* * * * *